US008596171B2

(12) United States Patent
Chen

(10) Patent No.: US 8,596,171 B2
(45) Date of Patent: Dec. 3, 2013

(54) NUT DRIVER FOR ELECTRICAL TERMINAL AND METHOD OF USING THE SAME

(75) Inventor: Ya-Sung Chen, Taoyuan County (TW)

(73) Assignee: Institute of Nuclear Energy Research Atomic Energy Council, Executive Yuan, Taoyuan County (TW)

( * ) Notice: Subject to any disclaimer, the term of this patent is extended or adjusted under 35 U.S.C. 154(b) by 61 days.

(21) Appl. No.: 12/981,891

(22) Filed: Dec. 30, 2010

(65) Prior Publication Data

US 2012/0085203 A1 Apr. 12, 2012

(30) Foreign Application Priority Data

Oct. 6, 2010 (TW) ..... 99133958 A

(51) Int. Cl.
*B25B 23/10* (2006.01)

(52) U.S. Cl.
USPC ..... 81/125; 81/443; 29/265; 606/99

(58) Field of Classification Search
USPC ..... 81/125, 58.1, 176.15, 451, 442–443
See application file for complete search history.

(56) References Cited

U.S. PATENT DOCUMENTS

| | | | | | |
|---|---|---|---|---|---|
| 2,370,407 | A * | 2/1945 | McCartney | 81/453 |
| 2,566,257 | A * | 8/1951 | Strunk | 81/125 |
| 2,574,352 | A * | 11/1951 | Senter | 81/125 |
| 4,706,868 | A * | 11/1987 | Hammerle et al. | 227/149 |
| 4,877,020 | A * | 10/1989 | Vich | 606/86 R |
| 5,163,345 | A * | 11/1992 | Doan et al. | 81/125 |
| 5,885,299 | A * | 3/1999 | Winslow et al. | 606/99 |
| 2010/0269643 | A1 * | 10/2010 | Kelly et al. | 81/125 |

* cited by examiner

*Primary Examiner* — Monica Carter
*Assistant Examiner* — Melanie Alexander
(74) *Attorney, Agent, or Firm* — WPAT, PC; Justin King

(57) ABSTRACT

A driver for a brass cylindrical type nut for an electrical terminal includes a handle, a sleeve, and a rotation axle. The handle has an exterior wall and an interior wall, in which the interior wall has a first accommodating space, and the exterior wall has a plurality of notches formed thereon in communication with the first accommodating space. The sleeve disposed in the first accommodating space and coupled to the interior wall further has a second accommodating space and a coupling opening arranged at a front end of the sleeve. The rotation axle is disposed in the second accommodating space and has a thread mated with the brass cylindrical type nut at an end corresponding to the coupling opening, while a rotation nut arranged within the first accommodating space and corresponding to the pair of notches is connected to the rotation axle.

10 Claims, 8 Drawing Sheets

NUT DRIVER FOR ELECTRICAL TERMINAL AND METHOD OF USING THE SAME

BACKGROUND OF THE INVENTION

1. Field of Invention

The present invention relates to a nut driver, and more particularly to a driver for a brass cylindrical type nut applied to an electrical terminal.

2. Related Art

FIG. 1 is a schematic view of an electric valve actuator for use in a nuclear power plant. Referring to FIG. 1, the electric valve actuator 1 mainly has a valve actuator body 10, a terminal board 11 is provided on one side of the valve actuator body 10, and serves as a bridge interface between all electrical communication within the valve actuator body 10 and an external controller 12. An exterior surface of the terminal board is connected to a plurality of electrical lines 13, so as to be electrically connected to the controller 12.

FIG. 2 is a schematic cross-sectional view of the terminal board of the electric valve actuator. In FIG. 2, the terminal board 11 has a plurality of through holes, each through hole has a conductive screw 110, and threads 111 and 112 on both ends of the conductive screw 110 are respectively on two side surfaces of the terminal board 11. The thread 112 is responsible for electrical connection between electrical elements inside the valve actuator body 10, while the thread 111 is responsible for electrical connection with the external controller 12. An air-tight ring 113 is provided between each conductive screw 110 and the terminal board 11. Generally speaking, the thread 111 of the conductive screw 110 on one side of the terminal board 11 has a conductive collar 15, which is fitted on the thread 111 of the conductive screw 110 and then fastened to the conductive screw 110 by a nut 14. Similarly, a conductive collar is also fitted on the thread 112 on the other side of the terminal board 11 and then fastened by a nut.

In the prior art, when the electric valve actuator 1 is to be maintained, it is necessary to loosen and take out the nut 14 on the conductive screw 110 coupled to the controller 12 and then take down the conductive collar 15 to facilitate maintenance. However, even if the maintainer can loosen the nut 14 by hand, the nut 14 easily falls off from the hand and drops to the bottom of the valve actuator body 10 due to its small volume. Moreover, since the facility layout in the nuclear power plant is limited by space, it is difficult to pick up the dropped nut 14, which is also time-consuming.

In view of the above, a nut driver for an electrical terminal is needed to solve the problem in the prior art.

SUMMARY OF THE INVENTION

The present invention is directed to a nut driver for an electrical terminal and a method of using the same, capable of partially loosening a nut coupled to the electrical terminal, locking a rotation axle in the nut, and then loosening the nut from the electrical terminal and taking it out, so as to prevent the nut from falling off when a user loosens the nut by hand.

In an embodiment, the present invention provides a nut driver for an electrical terminal, which includes: a handle, having an exterior wall and an interior wall, in which the interior wall has a first accommodating space, and the exterior wall has a pair of notches corresponding to each other formed thereon in communication with the first accommodating space; a sleeve, disposed in the first accommodating space and coupled to the interior wall, in which the sleeve further has a second accommodating space and a coupling opening at a front end thereof; and a rotation axle, accommodated in the second accommodating space, in which the rotation axle is further connected to a rotation nut accommodated in the first accommodating space and corresponding to the pair of notches, and the rotation axle has a thread mated with a brass cylindrical type nut at an end corresponding to the coupling opening.

In another embodiment, the present invention further provides a method of using a nut driver for an electrical terminal, which includes the following steps: providing a nut driver for an electrical terminal, which has a handle, a sleeve, and a rotation axle, in which the handle has a plurality of notches, the sleeve is disposed in the handle, and has a coupling opening at a front end thereof, the rotation axle is accommodated in the sleeve and corresponding to the plurality of notches, the rotation axle is further connected to a rotation nut, and the rotation axle has a thread mated with a brass cylindrical type nut at an end corresponding to the coupling opening; fitting and fastening the coupling opening on an exterior surface of a nut, in which a shape of the coupling end matches that of the nut and the nut is coupled to a screw; rotating the handle, such that the sleeve rotates simultaneously with the handle and drives the nut to rotate, so as to make the nut loose and move a distance upward, and leave a space at one end of the nut; rotating the rotation nut to drive the rotation axle to rotate, such that the thread at the front end of the rotation axle is coupled to a thread of the nut in the space and then is coupled to the nut; and continuing to rotate the handle such that the nut is rotated out and departs from the screw, and then taking out the nut by using the nut driver for the electrical terminal.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to make the features, objectives, and functions of the present invention more comprehensible, the related detailed structures and design ideas and reasons of the device of the present invention are illustrated below, so that the Examiner can understand the characteristics of the present invention. The detailed illustration is as follows.

Figure 3A:
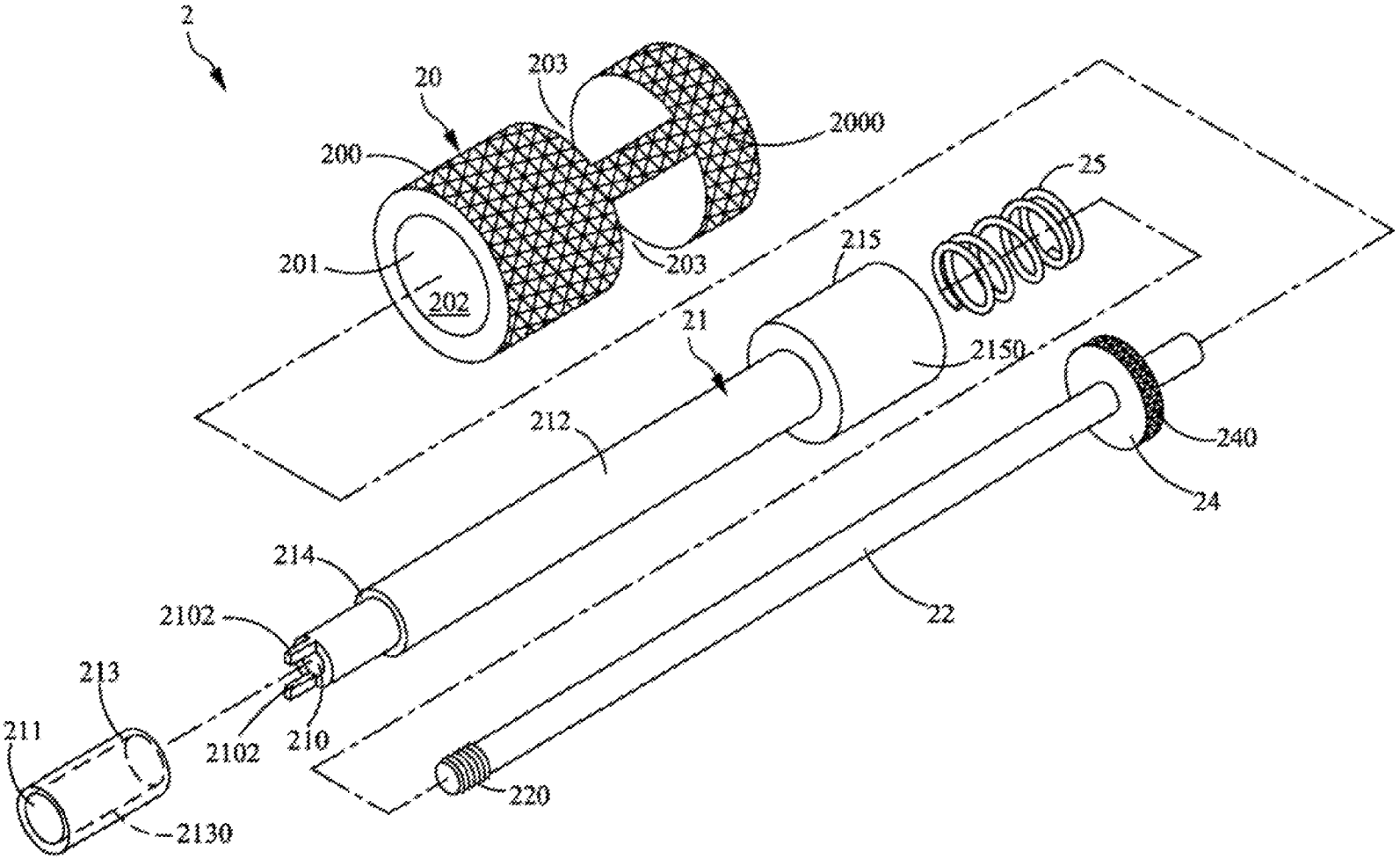
FIG. 3A is a schematic three-dimensional exploded view of a nut driver for an electrical terminal according to the present invention.
Figure 3B:
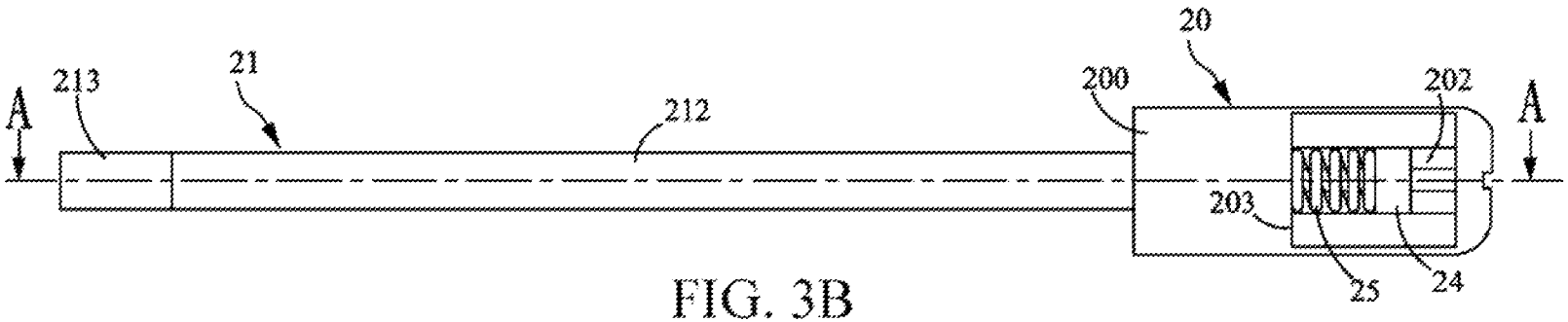
FIG. 3B is a schematic side view of the nut driver for the electrical terminal along AA.
Figure 3C:
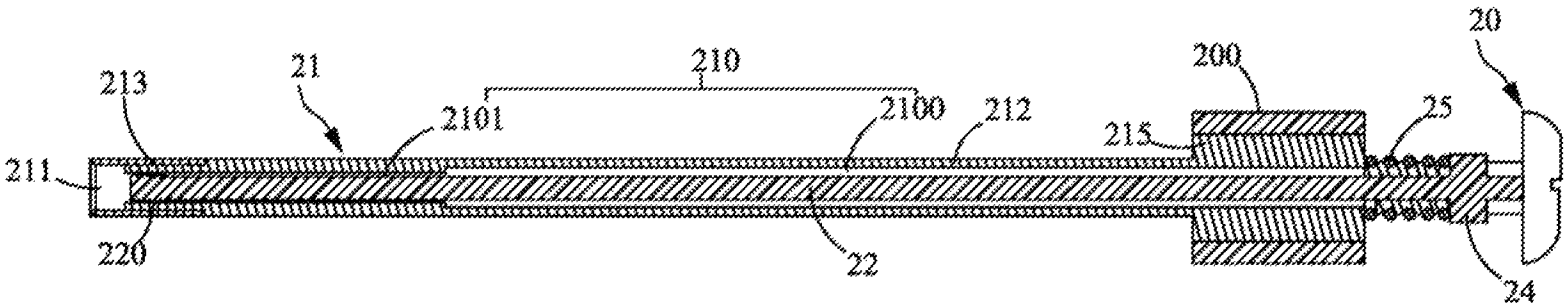
FIG. 3C is a schematic cross-sectional view of the nut driver for the electrical terminal.

FIG. 3A is a schematic three-dimensional exploded view of a nut driver for an electrical terminal according to the present invention; FIG. 3B is a schematic side view of the nut driver for the electrical terminal; and FIG. 3C is a schematic cross-sectional view of the nut driver for the electrical terminal along AA. Referring to FIGS. 3A to 3C, the nut driver 2 for the electrical terminal includes a handle 20, a sleeve 21, and a rotation axle 22. The handle 20 has an exterior wall 200 and an interior wall 201, and the interior wall 201 has a first accommodating space 202. The exterior wall 200 has a pair of notches 230 corresponding to each other formed thereon in communication with the first accommodating space 202. A material of the handle 20 may be a metal material or a polymer material, for example, plastic or Teflon. In this embodiment, the material of the handle 20 may be stainless steel. It should be noted that, the number of the notches 203 may also be larger than three, and the positions thereof may be determined as required, and are not limited by the embodiment shown in the figure. In addition, to facilitate gripping, an anti-slip emboss 2000 may further may formed on the exterior wall 200.

The sleeve 21 is disposed in the first accommodating space 202, and a portion of the sleeve 21 is coupled to the interior wall 201. The sleeve 21 further has a second accommodating space 210 with two lugs 2102 protruding from a wall at an end portion thereof. The sleeve 21 has a coupling opening 211 at a front end thereof. It should be noted that, in this embodiment, the second accommodating space 210 further has a first hollow portion 2100 and a second hollow portion 2101, and the second hollow portion 2101 is connected to the first hollow portion 2100 and has a diameter smaller than that of the first hollow portion 2100. The purpose of dividing the second accommodating space 210 into two hollow portions 2100 and 2101 with different diameters is to facilitate processing. Nevertheless, the first hollow portion 2100 and the second hollow portion 2101 may also have the same diameter. In addition, in this embodiment, the sleeve 21 includes a sleeve body 212 and a hollow guide pipe 213. The sleeve body 212 has an annular slot 214 on the periphery of the first end thereof and an engaging portion 215 on the second end thereof, and the engaging portion 215 has a hollow cylindrical structure. The second accommodating space 210 runs through the engaging portion 215, the sleeve body 212, and the hollow guide pipe 213. An interior pipe wall 2130 of the hollow guide pipe 213 is tightly coupled to the annular slot 214, the hollow guide pipe 213 has the coupling opening 211 on an end portion thereof, and an exterior annular wall 2150 of the engaging portion 215 is coupled to the interior wall 201. In this embodiment, the coupling is tight fitting.

Figure 4:
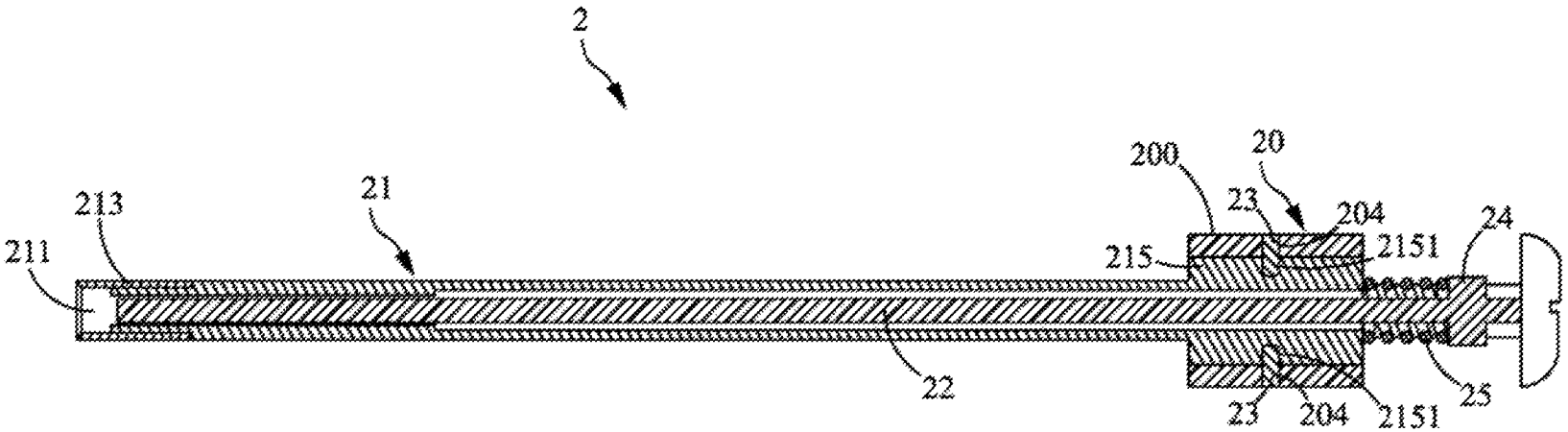
FIG. 4 is a schematic cross-sectional view of another embodiment of the present invention in which a handle and a sleeve are coupled.

In addition, in another embodiment, FIG. 4 is a schematic cross-sectional view of another embodiment of the present invention in which the handle and the sleeve are coupled. Referring to FIG. 4, in this embodiment, the engaging portion 215 further has a pair of positioning slots 2151 which are respectively disposed on two sides of a central axis of the engaging portion 215 and are corresponding to each other. A through hole 204 is respectively formed at positions of the handle 20 corresponding to the positioning slots 2151. Each through hole 204 allows a positioning pin 23 to pass through, such that the positioning pin 23 can be inserted into the positioning slot 2151, and no relative movement is produced between the handle 20 and the engaging portion 215. It should be noted that, although the embodiment shown in the figure illustrates a combination of a pair of through holes 204, a pair of positioning pins 23, and a pair of positioning slots 2151, in fact, the present invention can be implemented by the combination of at least one through hole, positioning slot, and positioning pin.

Referring back to FIGS. 3A to 3C, it should be noted that, a material of the sleeve 21 is a metal material, which is stainless steel (AISI 304) in this embodiment, but the present invention is not limited thereto. In addition, although the sleeve body 212 and the hollow guide pipe 213 are two separate elements in this embodiment, the sleeve body 212 and the hollow guide pipe 213 may also be an integral structure in another embodiment. The rotation axle 22 is accommodated in the second accommodating space 210, and is further connected to a rotation nut 24 accommodated in the first accommodating space 201 and corresponding to the pair of notches 203. The rotation axle 24 has a thread 220 mated with a brass cylindrical type nut at an end corresponding to the coupling opening 211. To enable a user to rotate the rotation nut 24 to drive the rotation axle 22 to rotate, an anti-slip emboss 240 may further be formed on a surface of the rotation nut 24. In addition, an elastic body 25 is further provided between the rotation nut 24 and the sleeve.

In this embodiment, the elastic body 25 is a spring directly abutting the rotation nut 24 and directly abutting the engaging portion 215. Although the elastic body is a spring in this embodiment, it is not limited thereto and may be any structure or material capable of accumulating the resilience and providing a reaction force to the rotation nut. In addition, it should be noted that, the elastic body 25 is not an essential element of the present invention, which is intended to restore the rotation nut 24 to the original position, and in the absence of the elastic body, the adjustment needs to be made manually. Nevertheless, the main implementation spirit of the present invention is not affected.

Figure 1:
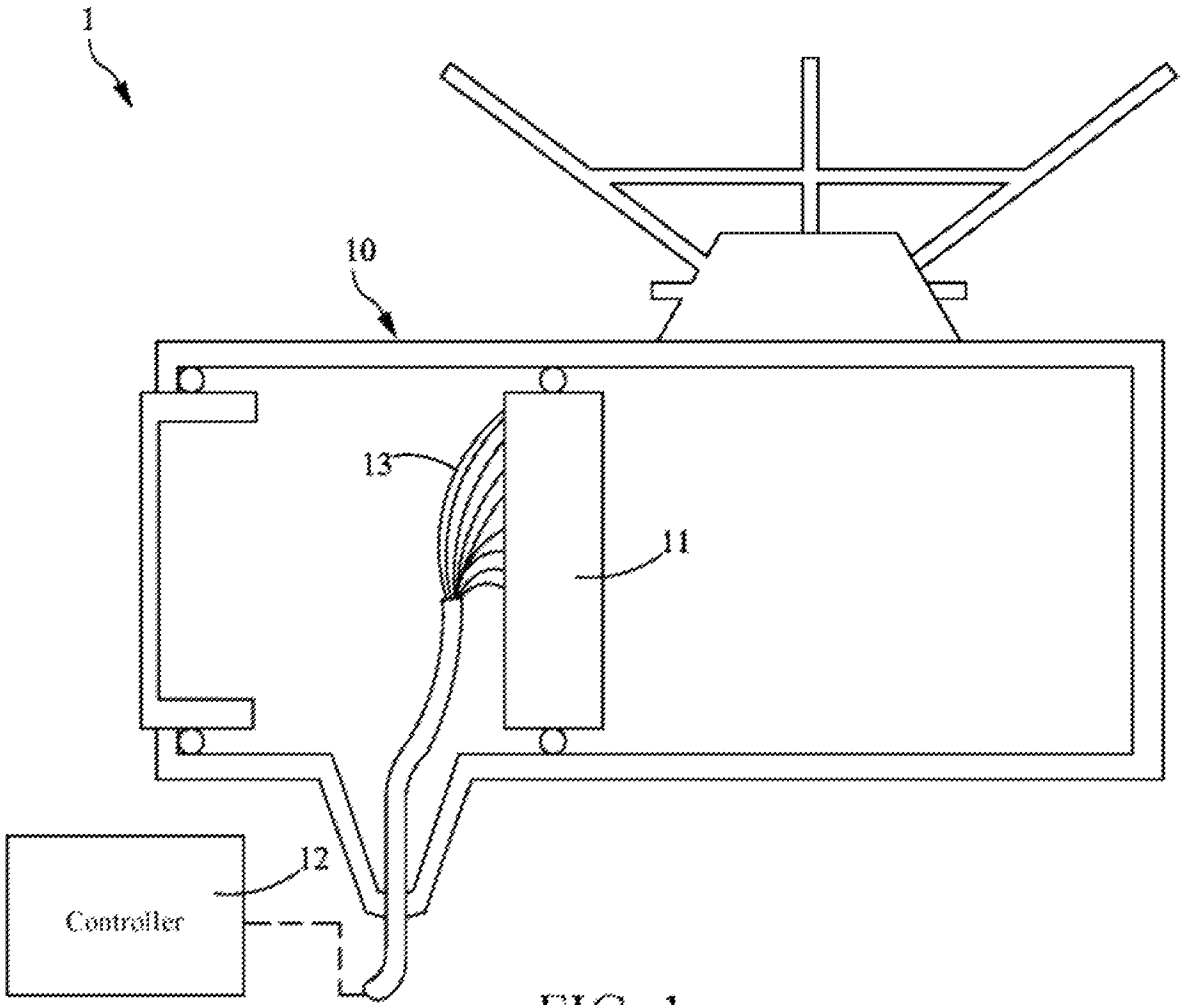
FIG. 1 is a schematic view of an electric valve actuator for use in a nuclear power plant.
Figure 2:
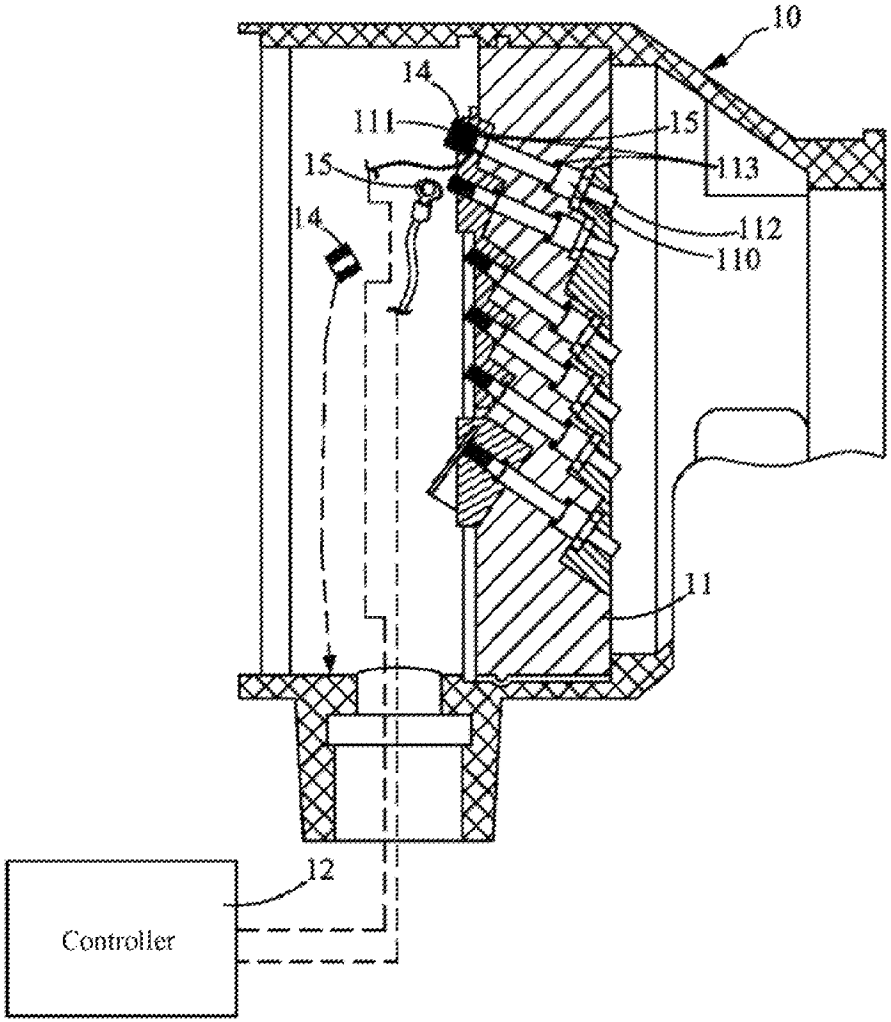
FIG. 2 is a schematic cross-sectional view of a terminal board of the electric valve actuator.
Figure 5A:
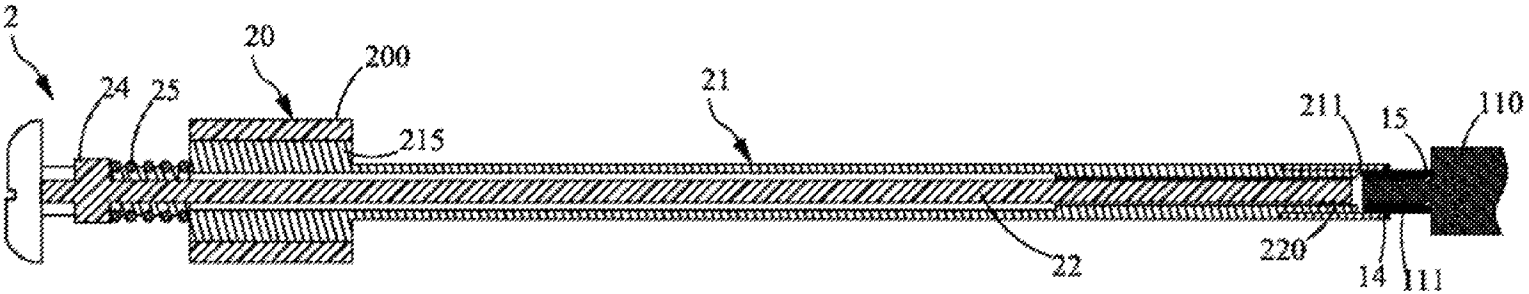
FIGS. 5A to 5F are schematic views of an implementation of detaching a nut by using the nut driver for the electrical terminal according to the present invention.
Figure 5B:
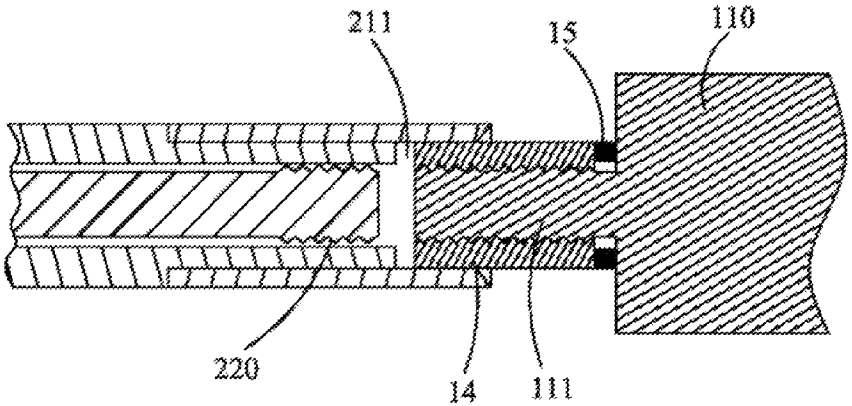
Figure 5C:
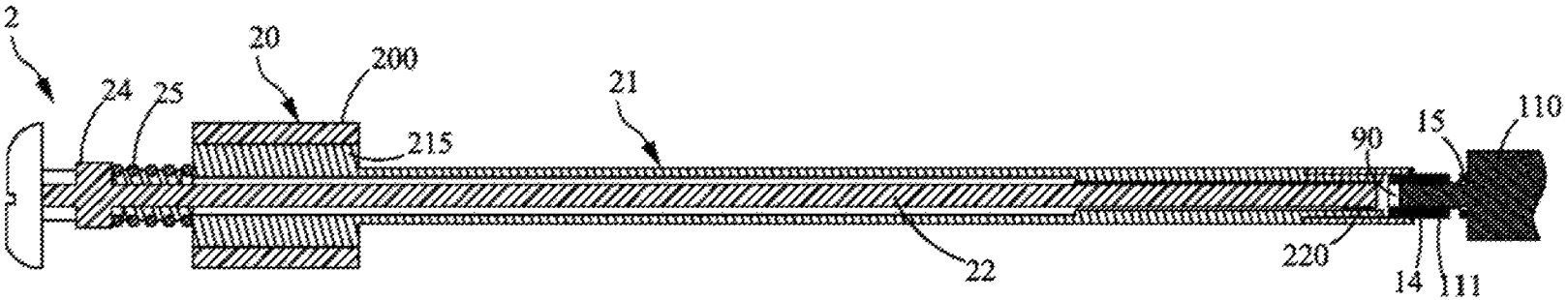

FIGS. 5A to 5F are schematic views of an implementation of detaching a nut by using the nut driver for the electrical terminal according to the present invention, in which FIG. 5B is a schematic partial enlarged view of coupling to the nut in FIG. 5A. First, as shown in FIGS. 5A and 5B, the coupling opening 211 at the front end of the nut driver for the electrical terminal is fitted on an exterior surface of the nut 14, in which the shape of the coupling opening 211 matches that of the nut 14. In this embodiment, the nut 14 is a brass cylindrical type nut. The nut 14 is coupled to a screw. In this embodiment, the screw is a conductive screw 110 on a terminal board in an electric valve actuator, and has a thread 111 thereon coupled to the nut 14. The structures of the electric valve actuator and the terminal board are shown in FIGS. 1 and 2, and will not be described herein again. It should be noted that, in this embodiment, the electric valve actuator is a Rotork electric valve actuator. Thus, the nut driver for the electrical terminal in this embodiment is a nut driver for an electrical terminal of a Rotork actuator. Then, as shown in FIG. 5C, the user grips the handle 20 and rotates it, and the rotation direction is a direction in which the nut 14 can get loose, such that the sleeve 21 rotates simultaneously with the handle 20 and drives the nut 14 to rotate. At this time, the user only needs to rotate the handle several turns to make the nut 14 loose and move a distance upward, such that a space 90 is left at one end of the nut 14.

Figure 5D:
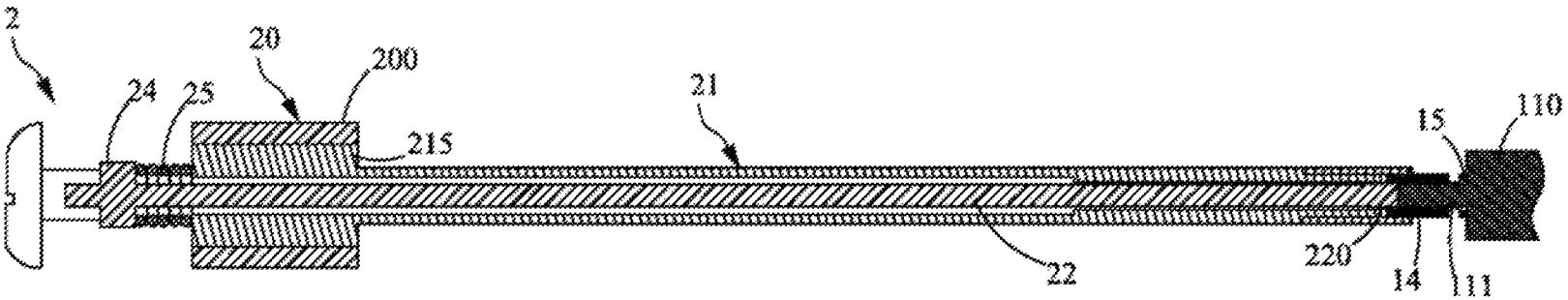
Figure 5E:
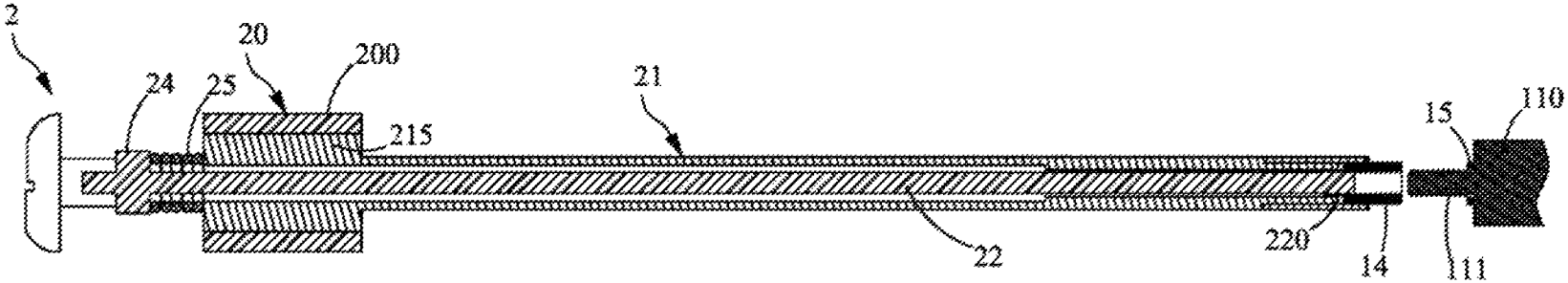
Figure 5F:
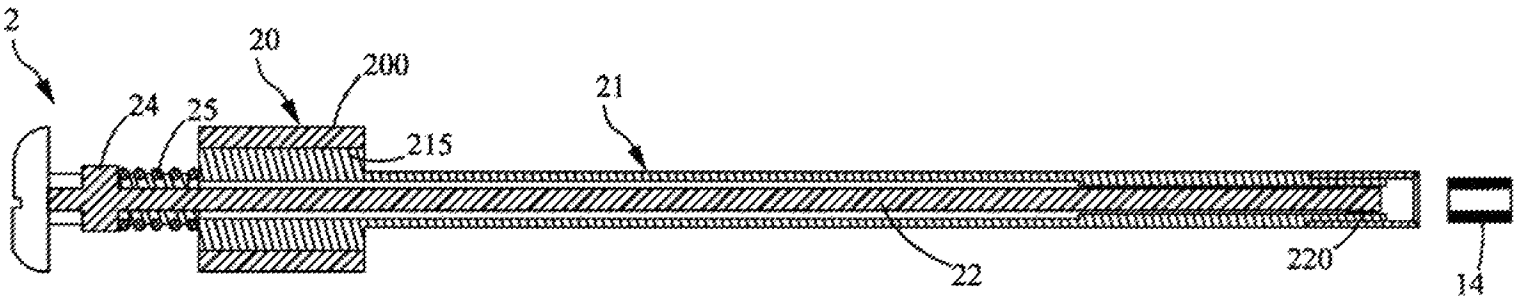

As shown in FIG. 5D, after the space 90 is removed at the upper end of the nut, the user then rotates the rotation nut 24. Since the rotation nut 24 is fixed on the rotation axle 22, when the rotation nut 24 is rotated, the rotation axle is driven to rotate, such that the thread at the front end of the rotation axle 22 is coupled to a thread in the space 90 and then is coupled to the nut 14. At this time, the rotation nut 24 compresses the elastic body 25, such that the elastic body 25 accumulates an elastic force. As shown in FIG. 5E, since the rotation axle 22 is already coupled to the nut 14, the user may continue to rotate the handle, such that the nut 14 is rotated out and departs from the thread 111. Since the rotation axle 22 is coupled to the nut 14, the nut 14 does not fall off, but is continuously coupled to the rotation axle 22 when the nut already departs from the thread 111. Finally, as shown in FIG. 5F, the user can take out the nut 14 by using the nut driver 2 for the electrical terminal. Finally, the user rotates the nut 14 by hand so as to separate the nut 14 from the rotation axle 22. When the nut 14 is taken down from the nut driver 2 for the electrical terminal, the elastic force accumulated by the elastic body 25 may push the rotation nut 24 back.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nut driver for driving a terminal nut at an electrical terminal, comprising:

a handle, having an exterior wall and an interior wall, wherein the interior wall has a first accommodating space, and the exterior wall has a plurality of notches formed thereon in communication with the first accommodating space;

a sleeve, disposed in the first accommodating space and fixed to the interior wall, wherein the sleeve further has a second accommodating space and a coupling opening at a front end thereof;

a rotation axle, accommodated in the second accommodating space, wherein the rotation axle is further connected to a rotation nut accommodated in the first accommodating space and corresponding to the plurality of notches, and the rotation axle has a thread mated with the terminal nut at an end corresponding to the coupling opening; and an elastic body directly abutting the rotation nut and directly abutting the sleeve for pushing the rotation nut away from the sleeve.

2. The nut driver according to claim 1, wherein the sleeve further comprises:

a sleeve body, with a first end and a second end, including an annular slot on the first end and an engaging portion on the second end; and a hollow guide pipe for accommodating the terminal nut;

wherein the second accommodating space runs through the engaging portion, the sleeve body, and the hollow guide pipe; and wherein an interior pipe wall of the hollow guide pipe is tightly coupled to the annular slot, the hollow guide pipe has the coupling opening on an end portion thereof, and an exterior annular wall of the engaging portion is coupled to the interior wall.

3. The nut driver according to claim 2, wherein the engaging portion is further provided with a positioning slot, and the handle further has a through hole formed at a position thereof corresponding to the positioning slot.

4. The nut driver according to claim 3, further comprising a positioning pin, inserted into the positioning slot through the through hole for fixing the sleeve to the interior wall of the handle.

5. The nut driver according to claim 1, wherein the second accommodating space further has a first hollow portion and a second hollow portion, and the second hollow portion is connected to the first hollow portion and has a diameter smaller than that of the first hollow portion.

6. The nut driver according to claim 1, wherein an anti-slip emboss is formed on the exterior wall.

7. The nut driver according to claim 1, wherein an anti-slip emboss is formed on an exterior surface of the rotation nut.

8. A method for driving a terminal nut in an electrical terminal, comprising:

providing a handle having an exterior wall and an interior wall, wherein the interior wall has a first accommodating space, and the exterior wall has a plurality of notches formed thereon in communication with the first accommodating space;

providing a sleeve with a second accommodating space and a coupling opening at a front end thereof;

inserting the sleeve into the first accommodating space, and fixing the sleeve onto the interior wall;

providing a rotation axle with a matching thread with the terminal nut;

providing a rotation nut, and connecting the rotation axel to the rotation nut;

inserting the rotation axel into the second accommodating space and the rotation nut is accommodated in the first accommodating space and corresponding to the plurality of notches;

fitting and fastening the coupling opening on an exterior surface of the terminal nut, wherein a shape of the coupling end matches that of the nut, and the terminal nut is coupled to a terminal screw;

rotating the handle, such that the sleeve rotates simultaneously with the handle and drives the terminal nut to rotate, so as to make the terminal nut loose;

rotating the rotation nut to drive the rotation axle to rotate, such that the rotation axle is coupled to the terminal nut;

continuing to rotate the handle such that the terminal nut is rotated out and departs from the terminal screw, and the terminal nut is rotated onto the matching thread of the rotation axle; and fitting an elastic body directly abutting the rotation nut and directly abutting the sleeve for pushing the rotation nut away from the sleeve.

9. The method according to claim 8, wherein the terminal screw is a conductive screw on a terminal board in an electric valve actuator.

10. The method according to claim 8, further comprises:

fitting a hollow guide pipe on the sleeve for accommodating the terminal nut.

* * * * *